United States Patent [19]

Kitano

[11] Patent Number: 4,832,157

[45] Date of Patent: May 23, 1989

[54] DISPLAYING DEVICE FOR ELEVATOR

[75] Inventor: Mamoru Kitano, Inazawa, Japan

[73] Assignee: Mitsubishi Denki Kabushiki Kaisha, Japan

[21] Appl. No.: 230,715

[22] Filed: Aug. 9, 1988

[51] Int. Cl.[4] ..... B66B 9/00

[52] U.S. Cl. ..... 187/1 R; 187/133; 340/825.62

[58] Field of Search ..... 187/1 R, 56, 130, 133, 187/136, 138, 132; 340/700, 686, 756, 286 M, 825.62

[56] References Cited

U.S. PATENT DOCUMENTS

| | | | |
|---|---|---|---|
| 3,742,445 | 6/1973 | Lauer | 187/130 |
| 3,973,648 | 8/1976 | Hummert et al. | 187/133 |
| 4,458,243 | 7/1984 | Sado et al. | 340/756 |
| 4,630,026 | 12/1986 | Lewis | 187/136 |
| 4,688,929 | 8/1987 | Tanigachi et al. | 340/715 |
| 4,724,933 | 2/1988 | Tsuji et al. | 187/137 |

FOREIGN PATENT DOCUMENTS 60-77079 5/1985 Japan .

*Primary Examiner*—Michael S. Huppert
*Assistant Examiner*—Kenneth Noland
*Attorney, Agent, or Firm*—Leydig, Voit & Mayer

[57] ABSTRACT

An elevator displaying device for displaying, in addition to the car position of the elevator, operating conditions, such and opening and closing states, of the car door to alert passengers who are about to get on the car of possible dangers resulting from the operation of the door. Detectors are provided for detecting the operating conditions of the car door.

5 Claims, 5 Drawing Sheets

DISPLAYING DEVICE FOR ELEVATOR

This application is a continuation of application Ser. No. 036,453, filed Apr. 9, 1987, now abandoned.

BACKGROUND OF THE INVENTION

This invention relates to a displaying device for displaying elevator operating information FIG. 5 is a front view of a prior-art displaying device for an elevator disclosed in Japanese Patent Application Laid-Open No. 60-77079. In FIG. 5, symbols 1D and 1U designate direction displaying lamps for displaying the operating direction of the elevator, and numeral 2 designates a 7-segment digital position displaying lamp for displaying the car position of the elevator. FIG. 6 is a front view of a door 3 of the elevator on which the digital position displaying lamp 2 and a hall button 4 are mounted in the vicinity thereof. FIG. 7 is a view of the construction of the digital position displaying lamp 2 having eight segments $L_1$ to $L_7$. FIG. 8 is a a diagram of a control circuit of the displaying device for the elevator. In FIG. 8, symbols $SU_1$ and $SD_1$ designate up and down relay contacts which are closed when the operating direction of the elevator car is decided, symbols LUP and LDN designate up and down displaying lamps which light when the up and down relay contacts are closed, symbol BK designates a run relay contact which is closed when the elevator car runs and is opened when the elevator car stops, numeral 20 designates a flicker circuit for periodically flickering the up and down displaying lamps LUP and LDP when the run relay contact BK of the elevator car is closed and continuously lighting the up and down displaying lamps LUP and LDN when the run relay contact BK of the elevator car is opened, symbols $S_1$ to $S_N$ designate floor contacts, numeral 10 designates a matrix circuit for displaying the car position of the elevator on the digital position displaying lamp 2 according to the floor contacts $S_1$ to $S_N$, and symbols $L_1$ to $L_7$ and $L_{11}$ to $L_{17}$ designate segment lamps which form the segments of the displaying lamp 2.

A case in which the elevator car is now stopped at the first floor and hall buttons 4 in third and fifth floors are pressed is considered. The up relay contact $SU_1$ is first closed. When the elevator car then runs, the run relay contact BK is closed, the flicker circuit 20 is periodically opened and closed, and the up displaying lamp LUP accordingly displays in a flickering manner.

When the elevator car then arrives at the third floor, the run relay contact BK is opened, the flicker circuit 20 is continuously closed, and the up displaying lamp LUP is lit to be displayed. When the elevator car runs to the fifth floor, the upward displaying lamp LUP is displayed in a flickering manner similarly to the above operation, the up relay contact $SU_1$ is opened when the car arrives at the fifth floor, and the up displaying lamp LUP is turned off. Similar operation is conducted when the car runs downward. The car position of the elevator is digitally displayed on the displaying lamp 2 in response to the opening and closing of the floor contacts $S_1$ to $S_N$.

Since the prior-art displaying device of the elevator is constructed as described above, elevator door opening and closing information is not provided. Thus, a passenger who gets on the car when the door is about to close may be injured or feel uncomfortable. Furthermore, without knowing in which direction the car is traveling, a passenger who waits in a hall may feel extremely anxious and uncertain, especially when the stopping time at the intermediate floors is long.

SUMMARY OF THE INVENTION

This invention has the objective of eliminating the above problems and has for its main object to provide an elevator displaying device which, in addition to displaying the car position of the elevator, also displays elevator door opening and closing information to prevent a passenger who is about to get on the cage from doing so because the car door may close on the passenger and to provide information of car stopping state for waiting passengers on other floors.

BRIEF DESCRIPTION OF THE DRAWINGS

In the drawings, the same symbols indicate identical or corresponding portions.

DESCRIPTION OF THE PREFERRED EMBODIMENTS

Figure 1:
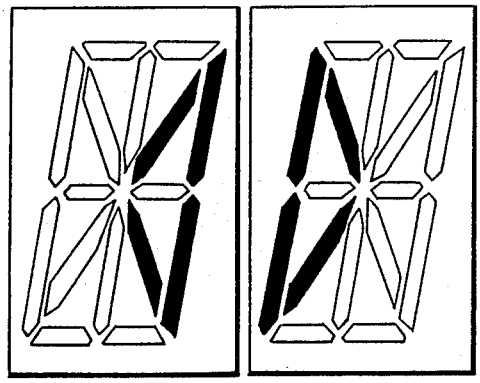
FIGS. 1(*a*) and 1(*b*) are views of displaying modes of an embodiment of a displaying device for an elevator when an elevator door is opened or closed according to this invention.
Figure 1:
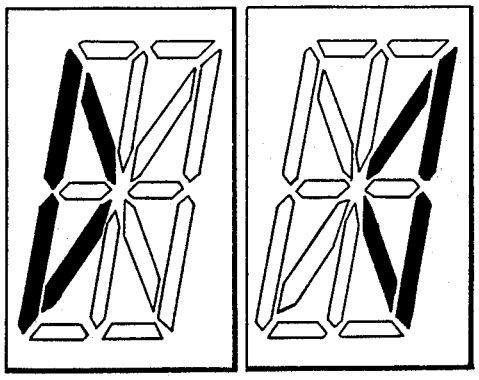
Figure 2:
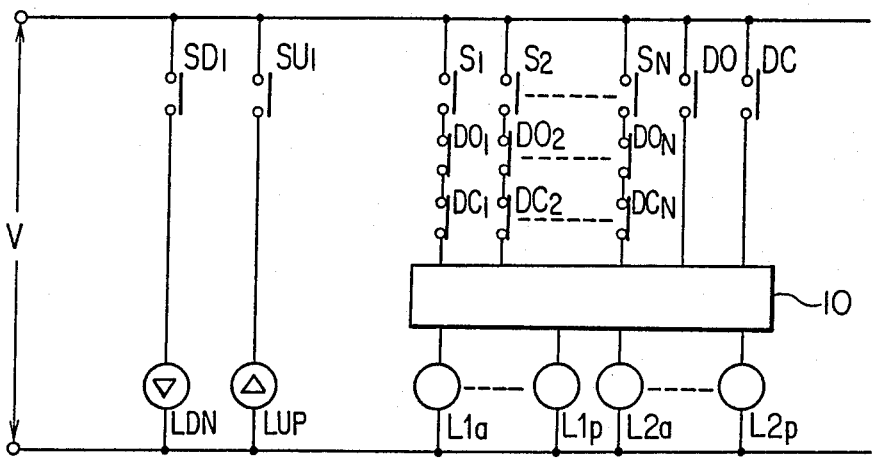
FIG. 2 is a circuit diagram of a control circuit for displaying the opening or closing of the door.
Figure 3:
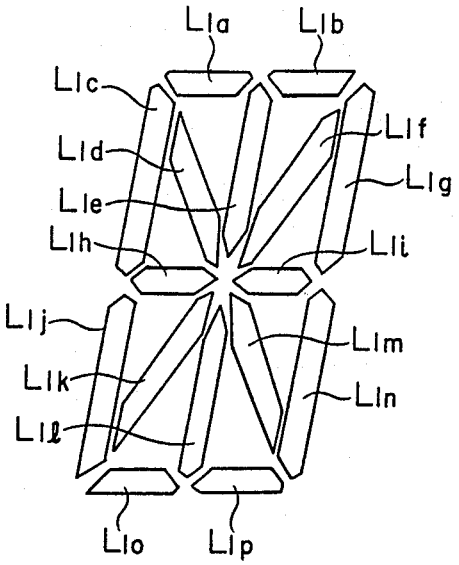
FIG. 3 is a view of the construction of a digital position displaying lamp of 16 segments.

A preferred embodiment of this invention will be described with reference to FIGS. 1(*a*), 1(*b*), 2, and 3. In FIG. 2, symbol DO designates a door open relay contact which is closed during opening operation of the door of an elevator, symbols $DO_1$ to $DO_N$ designate door open relay auxiliary contacts which are closed when the door open relay contact DO is closed, symbol DC designates a door close relay contact which is closed during the closing operation of the elevator door, and symbols $DC_1$ to $DC_N$ designate door open relay auxiliary contacts which are opened when the door open relay contact DC is closed. FIG. 3 shows a digital position displaying lamp consisting of 16 segments $L_1a$ to $L_1p$ for displaying the door opening or closing operation of the elevator door.

Next, the operation of the displaying device of this invention constructed as described above will be explained. The case in which the elevator car is stopped at first floor and the hall buttons 4 in third and fifth floors are pressed is considered. When the elevator car levels at the first floor, the floor contact $S_1$ is closed to display a character "1" on the digital position displaying lamp through the matrix circuit 10.

Then, the elevator car runs toward the third floor. The digital position displaying lamp displays characters of "2" and "3" according to the floor contacts $S_2$ and $S_3$ at this time. The elevator car then arrives at the third floor and enters the door opening operation. Since the door open relay contact DO is closed and the door open relay auxiliary contact $DO_3$ is opened during the door opening operation, the character of the digital position displaying lamp changes from "3" to a mark " ◁▷ ". After the door is completely opened, the door open relay contact DC is opened, and the door open relay auxiliary contact $DO_3$ is closed. Thus, the character of the digital position displaying lamp alters from the mark " ◁▷ " to "3". In the door closing operation, the character of the digital position displaying lamp similarly changes from "3" to the mark " ◁▷ " and to "3". Thus, the elevator car arrives at the fifth floor of the final target destination. The character of the digital position displaying lamp during this period changes "3" to "4" to "5". The digital position displaying lamp similarly displays at fifth floor during the door opening and closing operations to the third floor.

In the embodiment described above, the display of the digital position displaying lamp during the door closing operation is conducted by lighting the lamp. However, the digital position displaying lamp may alternately display the door closing display and the car position at door closing time. The display of the digital position displaying lamp at this time changes "3" to the mark " ◁▷ " to "3" to the mark " ◁▷ " to "3", . . . , mark " ◁▷ " to "3".

Figure 4:
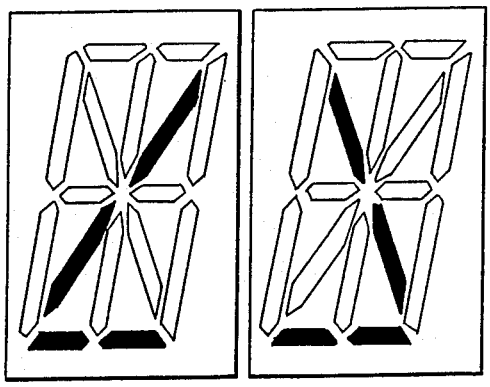
FIGS. 4(*a*) and 4(*b*) are views of displaying modes of up and down directions of another embodiment of a displaying device of for elevator according to this invention.
Figure 4:
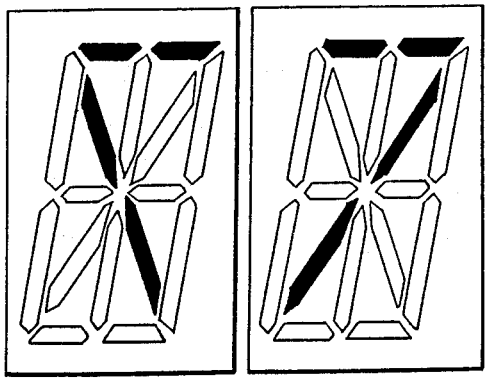
Figure 5:
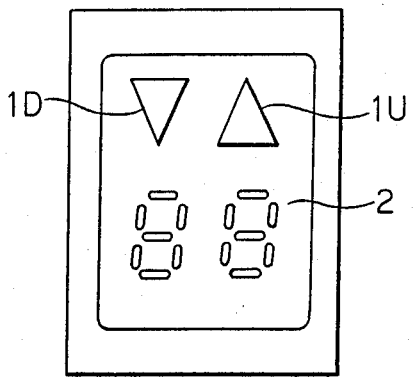
FIG. 5 PRIOR ART
FIG. 5 is a front view of a prior-art displaying device for an elevator.
Figure 6:
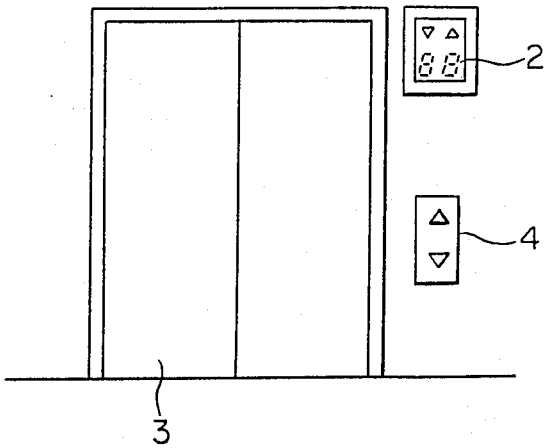
FIG. 6 PRIOR ART
FIG. 6 is a schematic view of an elevator hall.
Figure 7:
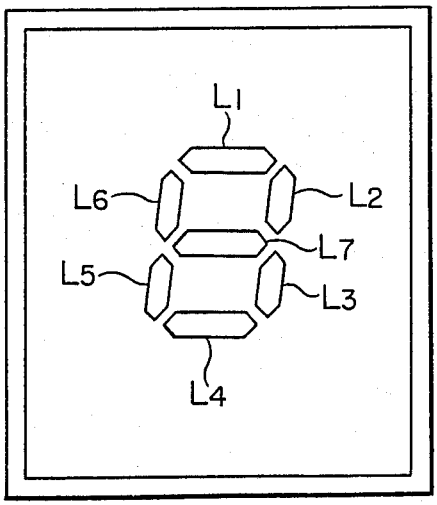
FIG. 7 PRIOR ART
FIG. 7 is a front view of a prior-art digital position displaying lamp of 7 segments.
Figure 8:
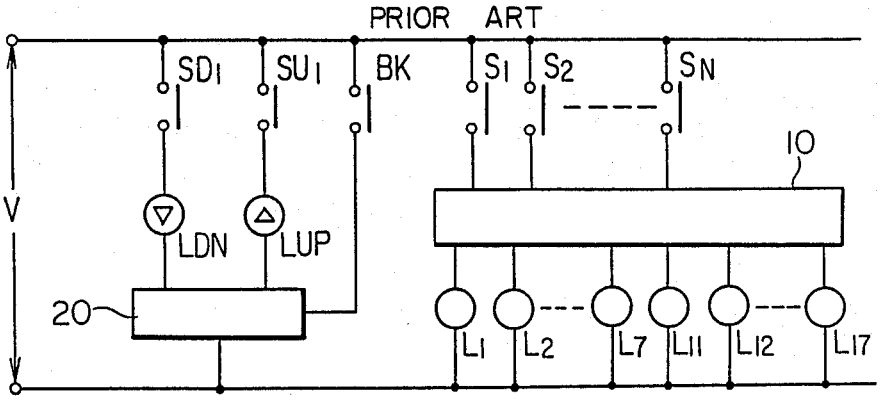
FIG. 8 PRIOR ART
FIG. 8 is a circuit diagram of a control circuit of the prior art displaying device.

In the embodiment described above, the display of the door closing operation of the elevator door is displayed by the mark " ◁▷ ". However, the same advantages as the above-described embodiment may also be provided even if the digital position displaying lamp displays the operating direction at door closing time as shown in FIG. 4 at the intermediate floor stopping time to the destination floor.

Further, the displaying device of the invention may be constructed to display together the operating direction of the elevator car in addition to the display of the opening and closing operations of the elevator door.

As described above, according to this invention, the displaying device is constructed that the elevator door opening and closing states are displayed in the position displaying means of the elevator. Therefore, the displaying device of the invention can alert the a passenger who is about to get on the elevator car of the danger of being caught between the closing doors and can provide information of elevator stopping time for passengers who wait in other floor halls.

What is claimed is:

1. An elevator displaying device comprising:

displaying means including a pair of multiple-segment display units provided in an elevator hall for displaying position of an elevator car by selected lighted segments of said display units which form numbers, detecting means for detecting opening and closing states of an elevator door, and display control means operatively connected to said displaying means and said detecting means for controlling the display on said pair of display units by the lighting of selected segments of both to provide one unit of information relative to the door opening and closing states to alert a passenger that the elevator door is being opened or closed, thereby displaying either elevator car position-representing numbers or door opening and closing states on the same device.

2. A display device for an elevator according to claim 1, wherein said display units each includes a 16-segment digital displaying unit.

3. A display device for an elevator according to claim 1 wherein said display control means is operated to control alternate displays of positional information of the elevator car and the opening and closing states of the elevator door when the elevator car stops at a floor.

4. A display device for an elevator according to claim 1 wherein said display control means is operated to control the display on said display units of signs representing operating directions of the elevator car.

5. An elevator display apparatus comprising a pair of single-digit, multiple-segment display units provided in an elevator hall adjacent doors which open and close to control entry to an elevator car, means providing electrical signals representing up or down operating directions of the elevator car, and display control means for operating said pair of display units to display, by the lighting of selected segments of said pair of units, numbers representing position of the elevator car and, responsive to the electrical signals, for operating said pair of units to display one unit of information representing up or down operating directions of the elevator car.

* * * * *